US005446424A

United States Patent [19]

Pierro

[11] Patent Number: 5,446,424

[45] Date of Patent: Aug. 29, 1995

[54] MICROWAVE CROSSPOINT BLOCKING SWITCH MATRIX AND ASSEMBLY EMPLOYING MULTILAYER STRIPLINE AND PIN DIODE SWITCHING ELEMENTS

[75] Inventor: John A. Pierro, East Meadow, N.Y.

[73] Assignee: AIL Systems, Inc., Deer Park, N.Y.

[21] Appl. No.: 245,698

[22] Filed: May 18, 1994

[51] Int. Cl.[6] ..... H01P 1/15

[52] U.S. Cl. ..... 333/104; 333/262; 340/825.96

[58] Field of Search ..... 333/101, 103, 104; 340/825.89, 825.94, 825.96

[56] References Cited

U.S. PATENT DOCUMENTS

| | | | |
|---|---|---|---|
| 3,813,497 | 5/1974 | Wachs et al. | 333/104 X |
| 3,833,866 | 9/1974 | Boutelant | 333/104 |
| 4,443,773 | 4/1984 | Rall et al. | 333/104 |
| 4,779,065 | 10/1988 | Katz et al. | 333/104 X |

FOREIGN PATENT DOCUMENTS

| | | | |
|---|---|---|---|
| 5258 | 1/1977 | Japan | 333/103 |

*Primary Examiner*—Paul Gensler

*Attorney, Agent, or Firm*—Hoffmann & Baron

[57] ABSTRACT

A microwave crosspoint blocking switch matrix and assembly employing multilayer stripline and pin diode switching elements is employed to selectively electrically couple and decouple input transmission lines to output transmission lines without severance of the transmission lines and insertion of a series switch. The microwave crosspoint blocking switch matrix assembly employs pin diode arrays coupled to input and output transmission lines at respective crosspoints. In order to route a signal from a specific input line to a selected output line, the pin diode array at the input/output transmission line crosspoint is activated and each transmission line is shorted at points one-quarter wavelength distant from the crosspoint to reflect, ideally, an infinite impedance at the interconnection point. Therefore, a desired signal cannot propagate in any direction except from the selected input line to the desired output line.

26 Claims, 4 Drawing Sheets

MICROWAVE CROSSPOINT BLOCKING SWITCH MATRIX AND ASSEMBLY EMPLOYING MULTILAYER STRIPLINE AND PIN DIODE SWITCHING ELEMENTS

BACKGROUND OF THE INVENTION

1. Field of the Invention

This invention relates to switches for routing the path an electronic signal travels, and more particularly to blocking switch matrices for routing the path an electronic signal travels from an input transmission line to one of a series of output transmission lines within an electronic circuit assembly.

2. Description of the Prior Art

Blocking switch matrices are well known in the electronics industry. Present blocking switch matrices are constructed in accordance with two approaches. The first utilizes orthogonal three-dimensional arrangements of transmission lines, directional couplers and solid state switches that are fabricated and assembled using Hybrid Microwave Integrated Circuitry (HMIC) techniques. The second utilizes Monolithic Microwave Integrated Circuitry (MMIC) techniques wherein crossed, nonintersecting transmission lines, interconnections and switch elements are integrated on a multilevel substrate (chip) using semiconductor processing techniques.

Switching devices fabricated utilizing the MMIC technique are preferable over switches made in accordance with the HMIC technique because the MMIC switches are smaller in size and, due to fewer welded interconnections, have improved reliability. However, both the HMIC and MMIC techniques suffer from drawbacks. Specifically, the HMIC technique produces assemblies which are both bulky and unreliable because of numerous welded interconnections. In addition, the switch matrices produced by the HMIC technique are relatively costly to produce due to the significant amount of manual labor required for assembly. The MMIC technique is impractical because chip size becomes very large due to the inherent circuit complexity, even for low order switching matrices, causing wafer yield to be low and therefore wafer cost to be high. Finally, both techniques require the splicing of input and output transmission lines for the insertion of either the HMIC or MMIC switching devices which can increase the time and cost required to produce such devices.

OBJECTS AND SUMMARY OF THE INVENTION

It is an object of the present invention to provide a blocking switch matrix and assembly for use with shielded strip transmission lines.

It is another object of the present invention to provide a blocking switch matrix which overcomes the inherent disadvantages of known blocking switch matrices and blocking switch matrix assemblies.

In accordance with one form of the present invention, a microwave crosspoint blocking switch matrix assembly includes at least a plurality of input microwave transmission lines, a plurality of output microwave transmission lines and a plurality of pin diode arrays. The microwave crosspoint blocking switch matrix assembly is capable of transmitting an input signal having a specific wavelength (λ) or range of wavelengths from a specific input transmission line to a selected output transmission line. This passing of the input signal is accomplished without severance of either transmission line at their crosspoint and insertion of a series switch component, which switch component is required in a conventional switch matrix.

A microwave crosspoint blocking switch matrix assembly includes a plurality of input microwave transmission lines selectively electrically coupled and decoupled to a plurality of output microwave transmission lines by a plurality of pin diode arrays. Each of the plurality of pin diode arrays is attached to one input transmission line and one output transmission line. Each of the input and output transmission lines are preferably spaced from adjacent respective input and output transmission lines by $$\frac{\lambda}{4 \cdot 2^N},$$

where N is a positive integer or zero and λ is the wavelength of the input signal being transmitted. However, the input transmission line can have a different spacing (i.e., a different integer N) than the output transmission line.

In a preferred form of the invention, each pin diode array includes first and second connection points for connection to corresponding input and output lines, respectively, and first and second nodes. More specifically, the first and second connection points of each pin diode array are respectively coupled to one of the plurality of input microwave transmission lines and one of the plurality of output microwave transmission lines. The pin diode array also includes at least first, second and third diodes wherein the cathode of the first diode and the anode of the second diode are coupled to the first node, the anode of the first diode and the cathode of the third diode are coupled to the second node, and the cathode of the second diode and the anode of the third diode are coupled to ground potential. The pin diode array also includes control lines coupled to the nodes and on which are provided selectable biasing voltages to turn on or off individual diodes of each array. Each pin diode array may also include at least one filter means coupled between the first node and the first connection point for blocking DC voltage from the control lines.

In accordance with another form of the present invention, a microwave crosspoint blocking switch matrix assembly includes at least a thin substrate supporting base plate (also referred to as the first stratum) with a first transmission line supporting stratum attached thereto. The first stratum includes a bottom metallic layer and a top dielectric layer with a plurality of first transmission lines embedded within the top dielectric layer. Each of the plurality of first transmission lines are spaced from corresponding adjacent transmission lines by $$\frac{\lambda}{4 \cdot 2^A},$$

where λ is the wavelength of the input signal provided to the switch matrix assembly, and A is a positive integer or zero.

Attached to the top dielectric layer of the first stratum is an intermediate stratum composed of a bottom layer of dielectric material and a top layer of metallic material.

The assembly also includes a second transmission line supporting stratum composed of dielectric material attached to the top metallic layer of the intermediate stratum, wherein the dielectric material of the second stratum has a plurality of second transmission lines embedded therein and spaced apart by $$\frac{\lambda}{4 \cdot 2^B}$$

where B is a positive integer or zero.

Embedded within the microwave crosspoint blocking switch matrix assembly are a plurality of pin diode arrays for coupling one of the first transmission lines to one of the second transmission lines. The assembly also includes a top covering stratum composed of a dielectric layer and a metallic layer superposed on the dielectric layer, wherein the dielectric layer of the top covering stratum is attached to the second stratum. The microwave crosspoint blocking switch matrix assembly may also include a plurality of cylindrical apertures adjacent to each transmission line, formed through the assembly from the metallic layer of the top covering stratum to the metallic layer of the first stratum. The walls which form each of the plurality of apertures are metal-plated so as to electrically couple the metallic layer of the top stratum to the metallic layer of the first stratum in order to provide electrical isolation of each transmission line from adjacent transmission lines.

A preferred form of the microwave crosspoint blocking switch matrix assembly employing multilayer stripline and pin diode switching elements, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
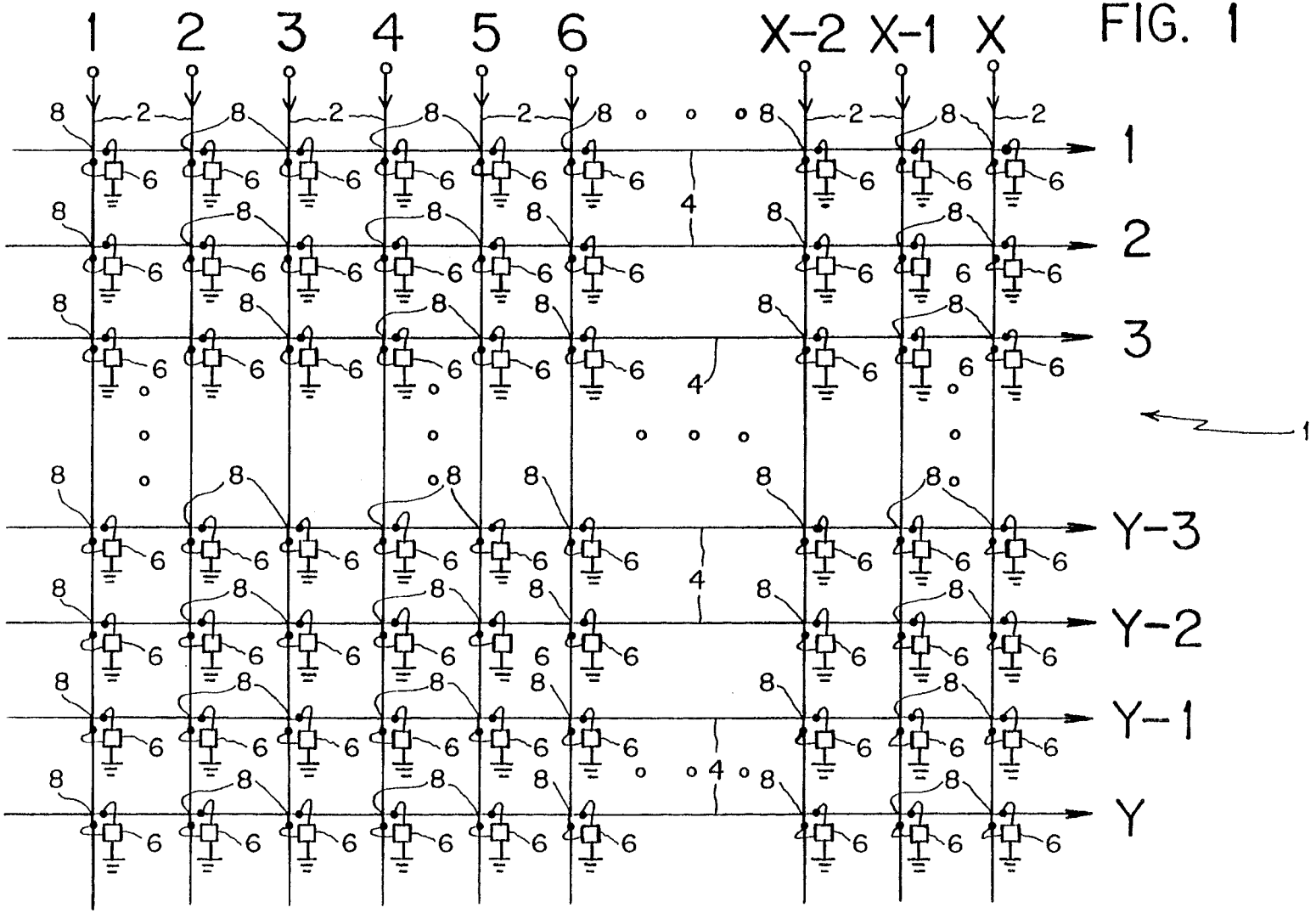
FIG. 1 is a block diagram of a microwave crosspoint blocking switch matrix assembly formed in accordance with the present invention.

Referring now to FIG. 1 of the drawings, a preferred form of a microwave crosspoint blocking switch matrix assembly employing multilayer stripline and pin diode switching elements constructed in accordance with the present invention will now be described. The microwave crosspoint blocking switch matrix assembly 1 is designed to electrically couple and decouple input microwave transmission lines to output microwave transmission lines without requiring the severance of the transmission lines and insertion of a series switch element.

The microwave crosspoint blocking switch matrix assembly 1 basically includes a plurality (X) of input transmission lines 2, a plurality (Y) of output transmission lines 4, and a plurality of pin diode arrays 6. Each of the plurality of pin diode arrays is coupled to one input transmission line and one output transmission line without duplication, so that the number of pin diode arrays required for constructing a microwave crosspoint blocking switch matrix assembly is substantially equivalent to the number of input transmission lines multiplied by the number of output transmission lines. Preferably, the transmission lines utilized in the present invention are shielded microwave stripline and the like. This type of transmission line provides a greater degree of electrical isolation to each individual stripline than unshielded transmission lines so that the signal being transmitted will have a reduced likelihood of experiencing electrical interference from neighboring transmission lines. Adjacent input transmission lines, while aligned in parallel, are preferably spaced a sufficient distance from one another so as to avoid significant cross-coupling. Likewise, adjacent output transmission lines which are aligned in parallel are also spaced a sufficient distance from one another in order to avoid significant cross-coupling.

Figure 2:
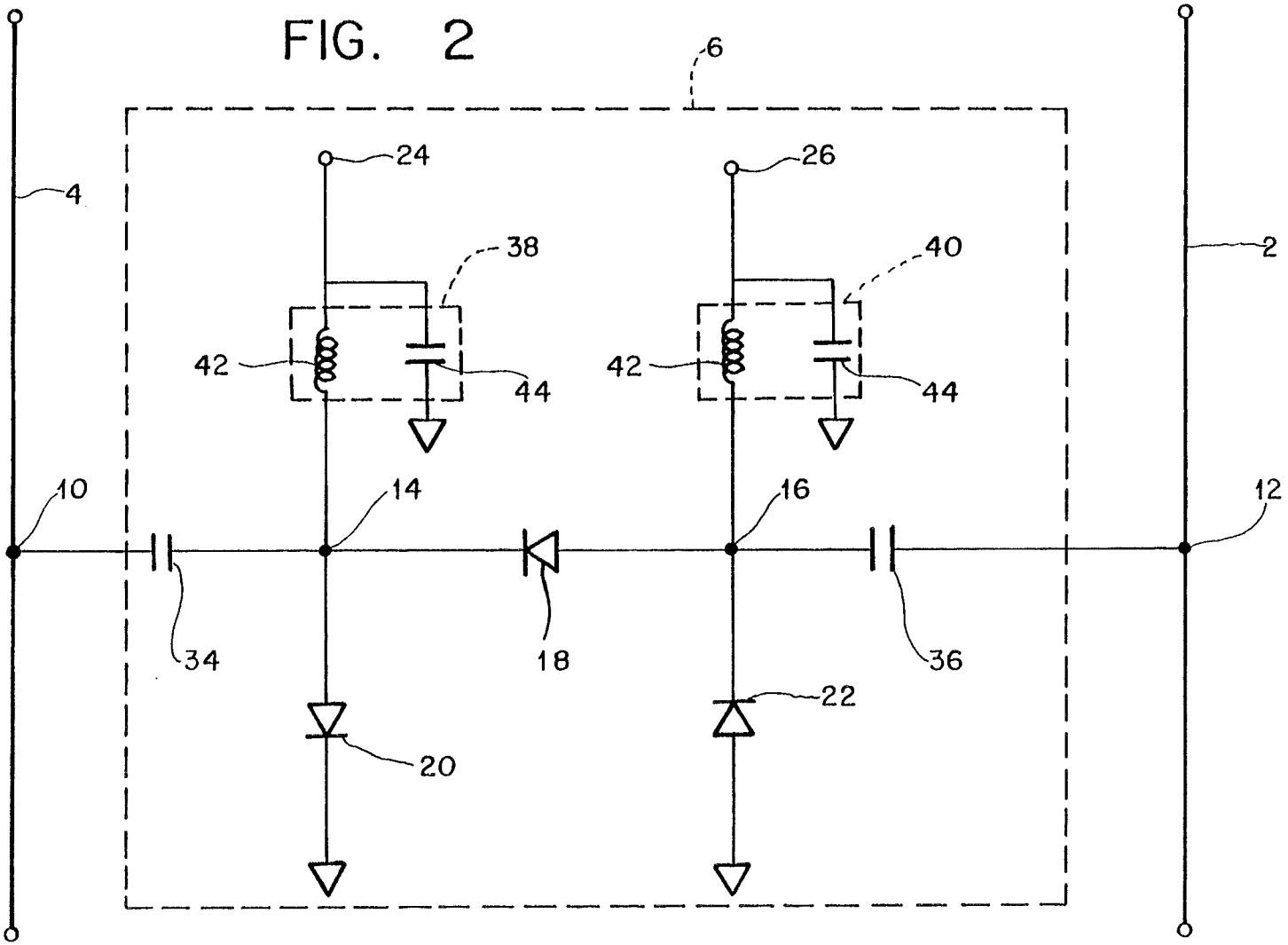
FIG. 2 is a functional block diagram of one form of a microwave crosspoint blocking switch matrix formed in accordance with the present invention.

In a preferred embodiment of the present invention and as shown in FIG. 1, a pin diode array 6 is coupled from each input transmission line 2 to each output transmission line 4 at or near a crosspoint 8 of each input and output transmission line. As shown in FIG. 2, the pin diode array 6 includes first and second connection points 10,12 and first and second nodes 14,16. Proximate to each crosspoint 8, connection point 12 is coupled to an input transmission line and connection point 10 is coupled to an output transmission line. The pin diode array 6 need not be coupled to each transmission line at the precise crosspoint of the input and output transmission lines. Instead, connection points of the pin diode array 6 need only be substantially proximate to the crosspoint 8 of the input and output transmission lines. It is important to note that the transmission lines need not be severed for insertion of the pin diode array as was required for prior art switching matrices. Instead, the pin diode array is coupled at its connection points 10,12 to the respective transmission lines 2,4 by ribbon-bonding, soldering or by other suitable methods.

As shown in FIG. 2, each pin diode array 6 includes at least first, second and third diodes 18,20,22. The first diode 18 is connected between an input transmission line 2 and an output transmission line 4 and is biased on or off to selectively provide the interconnection of the two transmission lines. The second and third diodes 20,22 are respectively connected between an output transmission line 4 and ground and an input transmission line 2 and ground. Each of the second and third diodes act as a variable line termination by being selectively biased on or off. Preferably, the cathode of the first diode 18 is coupled to the first node 14 while the anode of the first diode is coupled to the second node 16. Furthermore, the anode of the second diode 20 is coupled to the first node 14 while the cathode of the third diode 22 is coupled to the second node 16. Finally, the cathode of the second diode 20 and anode of the third diode 22 are coupled to ground potential. Of course, it should be realized that the polarities of the diodes may be reversed with equal results, as long as the proper biasing is applied.

Each pin diode array 6 includes a pair of control lines 24,26 respectively coupled to nodes 14,16. Selectable DC biasing voltages V (i.e., positive, negative or zero voltages with respect to ground potential) are provided on the control lines 24,26 of the array to forward bias (turned on) or reverse bias (turned off) the selected individual pin diodes of the arrays. Normally, zero voltage is provided on the control lines of each pin diode. As a result, the diodes of each pin diode array are normally off so that there are no connections between the input and output transmission lines. However, when a signal is to be provided from an input transmission line to an output transmission line, proper biasing voltages are supplied for the duration of the connection.

For example, a positive voltage on line 26 provided to node 16 and, simultaneously, a negative or zero voltage on line 24 provided to node 14 will forward bias (turn on) the interconnecting diode (i.e., first diode 18) to the conductive state. Diode 18 will thus appear as a short circuit between the respective input and output transmission lines 2,4 to which it is connected, thereby interconnecting the two transmission lines to allow the input signal to be transferred from the input transmission line 2 to the output transmission line 4 controlled by that particular pin diode array 6.

Alternatively, by simultaneously applying a negative or zero voltage to control line 26 and a positive or zero voltage to line 24, first diode 18 will be reverse biased (turned off) so that the pin diode array 6 appears as an open circuit between the respective input and output transmission lines 2,4 to which the pin diode is connected. In this state, the pin diode array 6 will prevent the input signal from being transferred from input transmission line 2 to output transmission line 4.

As for the termination diodes (i.e., second and third diodes 20,22), a positive voltage on control line 24 will forward bias diode 20, and a negative or zero voltage on control line 24 will turn off diode 20 while a negative voltage on control line 26 will turn on diode 22, and a positive or zero voltage on line 26 will turn off diode 22.

The termination diodes 20,22 of two pin diode arrays 6, a first situated $\lambda/4$ along an input transmission line and a second situated $\lambda/4$ along an output transmission line from a particular crosspoint 8 of the two transmission lines to be switched, operate in conjunction with the interconnecting diode 18 of the pin diode array situated at the crosspoint. The interconnecting diode 18 will selectively interconnect the input and output transmission lines 2,4 to which it is connected when the proper bias voltage is provided to the diode 18 on control lines 24,26. Simultaneously, the second diode 20 connected to the selected output transmission line and situated $\lambda/4$ away from the crosspoint of the two transmission lines in a second pin diode array is forward biased by providing a sufficient biasing voltage on control line 24 of the second array (containing the second diode 20). In addition, the third diode 22 connected to the selected input transmission line and situated $\lambda/4$ away from the crosspoint in a third pin diode array is forward biased by providing a sufficient biasing voltage on control line 26 of the third pin diode array (containing the third diode). The two termination diodes 20,22, being forward biased, appear as short circuits in their respective pin diode arrays, but appear as open circuits $\lambda/4$ away at the crosspoint of the input and output transmission lines being coupled together by interconnection diode 18. Accordingly, at the respective crosspoint, the signal transferred from the input transmission line 2 to the output transmission line 4 sees a high impedance on the transmission lines and is therefore not loaded down or attenuated.

Figure 3:
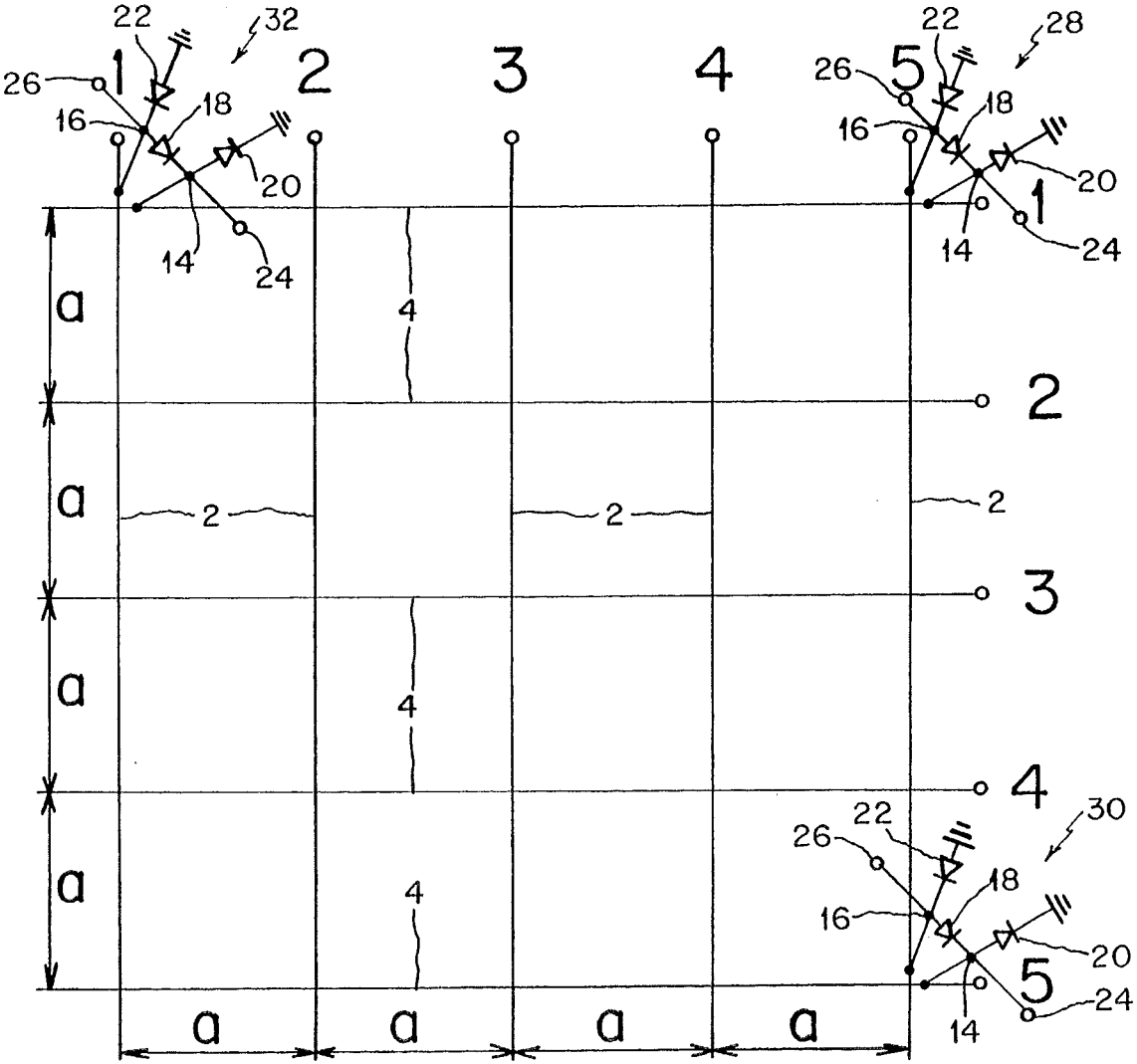
FIG. 3 is a simplified schematic diagram of a microwave crosspoint blocking switch matrix assembly formed in accordance with the present invention.

Referring now to FIG. 3, an example of how the microwave crosspoint blocking switch matrix of the present invention operates will be described. FIG. 3 illustrates a $5\times5$ blocking switch matrix array having five input transmission lines 2 numbered #1–5 and five output transmission lines 4 numbered #1–5 wherein an input signal (having a wavelength $\lambda$ or range of wavelengths) is provided on input transmission line number #5 and thereafter provided on output transmission line number #1. Preferably, each input transmission line 2 is spaced $\lambda/16$ apart (shown if FIG. 3 as dimension "a") from adjacent input transmission lines 2. Likewise, each output transmission line 4 is spaced $\lambda/16$ apart. (shown in FIG. 3 as dimension "a") from adjacent output transmission lines 4. However, the adjacent input and output transmission lines can be spaced apart by any distance derived from the mathematical relationship:

$$\frac{\lambda}{4\cdot 2^N}$$

where N is a positive integer or zero. It should be noted that the integer N that is used for deriving the required spacing of the input transmission lines 2 can be different than the integer N used for the spacing of the output transmission lines 4. As described above, and for the purposes of illustration, input transmission line number 5 and output transmission line number 1 are the respective input and output transmission lines utilized for the example of the operation of the microwave crosspoint blocking switch matrix.

The microwave crosspoint blocking switch matrix of FIG. 3 preferably includes a plurality of pin diode arrays 6 (however, only three pin diode arrays 28,30,32 are shown) respectively coupling each input microwave transmission line 2 to each output microwave transmission line 4 without duplication. The pin diode arrays are preferably placed at or near a crosspoint 8 of respective input and output microwave transmission lines. Based upon the selected input transmission line and output transmission line (i.e., input microwave transmission line number #5 and output microwave transmission line number #1), specific diodes 18,20,22 of specific pin diode arrays will be activated to provide transmission of the signal from the input microwave transmission line number #5 to the selected output microwave transmission line number #1.

In order to provide the input transmission signal from input transmission line number #5 to output transmission line number #1, pin diode array 28 (having first, second and third diodes 18,20,22 and control lines 24,26) located at the crosspoint of input transmission line number #5 and output transmission line number #1 must be activated. More specifically, pin diode array 28 includes an interconnecting diode 18 coupled between input transmission line number #5 and output transmission line number #1. The interconnecting diode 18 is selectively biased on and off to couple and decouple input transmission line number #5 and output transmission line #1. The pin diode array 28 also includes second and third diodes 20,22 respectively coupled between the output transmission line number #1 and ground and the input transmission line number #5 and ground, which act as variable line terminations by selectively being biased on or off.

As stated above, pin diode array 28 includes control lines 24,26 respectively coupled to nodes 14,16. The first, second and third diodes 18,20,22 of pin diode array 28 are normally off with zero voltage provided on control lines 24,26. Selectable DC biasing voltages V (i.e., positive, negative or zero voltages with respect to ground potential) are provided on the control lines 24,26 of pin diode array 28 to forward bias (turn on) and reverse bias (turn off) specific diodes.

Specifically, in order to activate interconnecting diode 18 of pin diode array 28 (first diode 18), a positive voltage is provided on control line 26 to node 16 of pin diode array 28, and, simultaneously, a negative or zero voltage is provided on line 24 to node 14 of pin diode array 28. Thus, the interconnecting diode 18 of pin diode array 28 (first diode 18) will be forward biased and thus appear as a short circuit between input transmission line number #5 and output transmission line number #1, thereby interconnecting the two transmission lines.

In addition to activating the interconnecting diode (first diode 18) of pin diode array 28, specific termination diodes (i.e., second and third diodes 20,22) located at specific input transmission line 2 and output transmission line 4 crosspoints must also be activated to properly route the input signal from input transmission line number #5 to output transmission line number #1. Specifically, the pin diode arrays that are located in directions that it is not desired to have the input signal travel and which are located $\lambda/4$ (or any multiple thereof, i.e., $3\lambda/4$, $5\lambda/4$. . . ) from pin diode array 28 are activated.

In view of the above and having elected to provide an input signal from input transmission line number #5 to output transmission line number #1, pin diode arrays 30,32, which are respectively located $\lambda/4$ along the input transmission line number #5 and output transmission line number #1 and which are located in directions of desired non-transmission of the input signal are activated to effectively block the transmission of the input signal in the direction of location of the respective pin diode arrays 30,32.

The termination diodes (diodes 20,22) of pin diode arrays 30,32 situated $\lambda/4$ away from the crosspoint of input transmission line number 5 and output transmission line 1 are activated as follows. A positive voltage on control line 24 of pin diode array 32 will forward bias second diode 20 connected to selected output transmission line number 1. In addition, third diode 22 of pin diode array 30 will be forward biased by providing a negative voltage on control line 26 of pin diode array 30. The two termination diodes (second diode 20 at pin diode array 32 and third diode 22 of pin diode array 30) being forward biased, appear as short circuits in their respective pin diode arrays 30,32, but appear as open circuits $\lambda/4$ away at the crosspoint of the input transmission line number 5 and output transmission line number 1. Accordingly, the signal provided on input transmission line number 5 sees a high impedance on the input and output transmission lines at the crosspoint and is therefore not loaded down or attenuated. As a result, substantially complete transmission of the input signal from a selected input transmission line to a selected output transmission line can occur without utilizing and inserting a service switching component. It should be noted that more than one combination of input transmission lines and output transmission lines may be simultaneously switched in the microwave crosspoint block switch matrix assembly of the present invention. Therefore, respective input signals may be provided on adjacent input transmission lines and transferred to adjacent output transmission lines by forward biasing selected diodes of pin diode arrays of the switch matrix assembly.

Returning again to FIG. 2 of the drawings, in a preferred embodiment of the present invention, each pin diode array 6 may further include first filter means 34 coupled between the first connection point 10 and first node 14, and second filter means 36 coupled between the second connection point 12 and the second node 16. The first and second filter means 34,36 preferably include at least one capacitor for blocking DC voltage provided to control lines 24,26 in order to electrically isolate the pin diode array 6 from the transmission lines and the circuit to which each pin diode array is coupled. The pin diode array 6 may also include first and second decoupling filter circuits 38,40 interposed in and coupled to the control lines 24,26 respectively. Each decoupling filter circuit 38,40 preferably includes at least one inductor 42 and one capacitor 44 connected in parallel so as to form an LC filter circuit.

Figure 4:
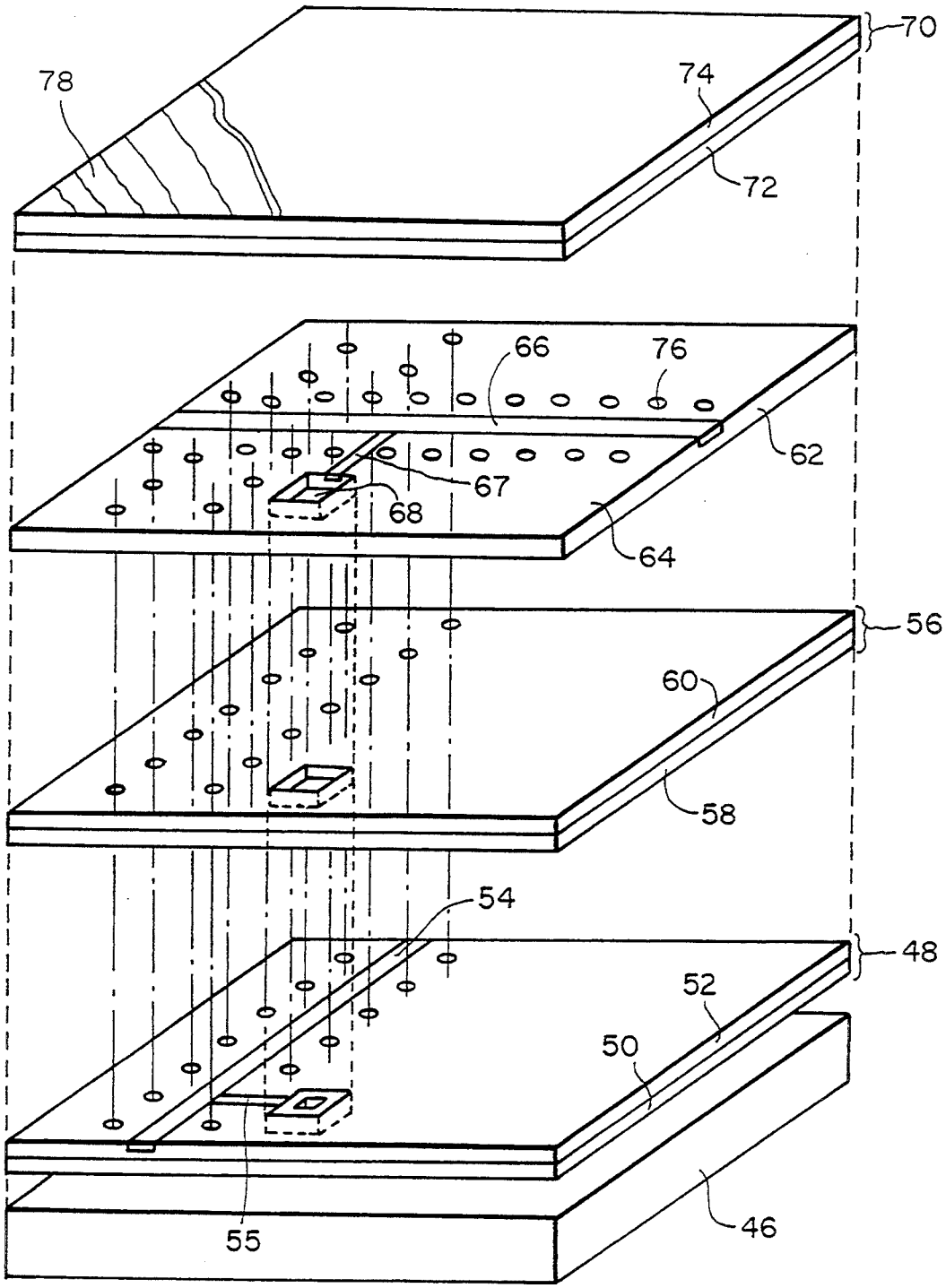
FIG. 4 is a perspective view of a preferred arrangement of the microwave crosspoint blocking switch matrix assembly employing multilayer stripline and pin diode switching elements formed in accordance with the present invention.

One form of a crosspoint switch matrix assembly of the present invention is shown in FIG. 4 wherein the microwave crosspoint blocking switch matrix assembly is designed for providing an input signal having a specific wavelength ($\lambda$), or range of wavelengths, from an input transmission line 2 to an output transmission line 4. The microwave crosspoint blocking switch matrix assembly shown in FIG. 4 basically includes a thin substrate supporting base plate 46 which is preferably constructed from a metallic conductive material. Attached to the top of the base plate 46 is a first transmission line supporting stratum 48 which includes a bottom metallic layer 50 affixed to the base plate 46, and a top dielectric layer 52. The dielectric layer preferably has a plurality of shielded transmission lines 54 embedded therein or formed on its surface. Adjacent transmission lines are preferably spaced apart by $$\frac{\lambda}{4 \cdot 2^A}$$

where A is either a positive integer or zero and $\lambda$ is the wavelength of the input signal. In a preferred embodiment of the invention, adjacent transmission lines are spaced $\lambda/16$ apart. Preferably, the layers of the first stratum 48, specifically the dielectric and metallic layers 52,50, have a substantially uniform thickness over their entire length and width.

Attached to the dielectric layer 52 of the first transmission line supporting stratum 48 is an intermediate stratum 56 which preferably includes a bottom dielectric layer 58 and a top metallic layer 60. Preferably, the dielectric layer 58 of the intermediate stratum 56 is affixed to the dielectric layer 52 of the first transmission line supporting stratum 48. The intermediate stratum 56, with its metallic layer 60, is designed to provide electrical isolation of the transmission lines 54 formed in the first transmission line supporting stratum 48. Preferably, both the dielectric layer 58 and metallic layer 60 of the intermediate stratum 56 have a substantially uniform thickness over their entire length and width.

Attached to the intermediate stratum 56 is a second transmission line supporting stratum 62 which is preferably made of a dielectric material 64 having a plurality of transmission lines 66 embedded therein (or formed on one of its surfaces). The transmission lines 66 may be stripline or cylindrical conductor. Adjacent transmission lines 66 are preferably spaced apart by $$\frac{\lambda}{4 \cdot 2^B}$$

where B is either a positive integer or zero and λ is the wavelength of the input signal. In a preferred embodiment of the invention, adjacent transmission lines 66 are spaced λ/16 apart. The B chosen for the spacing of the second transmission line need not be the same as the A chosen for the spacing of the first transmission lines. Furthermore, the dielectric layer of the intermediate stratum preferably has a substantially uniform thickness over its entire area. The transmission lines 54,66 of the first and second supporting strata 48,62 may function as either input transmission lines 2 or output transmission lines 4 (See FIG. 1).

The microwave crosspoint blocking switch matrix assembly further includes a plurality of pin diode arrays 6 preferably embedded within at least one of the first transmission line supporting stratum 48, the intermediate stratum 56 and the second transmission line supporting stratum 62. The pin diode arrays 6, each having two connection points 10,12, are preferably located at each crosspoint of the transmission lines 54,66. The two connection points 10,12 of the pin diode arrays 6 are respectively coupled to the transmission lines 54,66 proximate to each crosspoint. The pin diode arrays 6 are inserted in the assembly by drilling or otherwise forming an aperture 68 in the assembly, and placing the pin diode array 6 therein. Thereafter, the pin diode array 6 is electrically connected to the transmission lines 54,66 at its connection points 10,12 proximate to the crosspoint of the transmission lines by conductive strip 55,67 respectively.

The microwave crosspoint blocking switch matrix assembly further includes a top covering stratum 70 which is attached to the top of the second transmission line supporting stratum 62. The top covering stratum 70 includes a bottom dielectric layer 72 and a top metallic layer 74 wherein the dielectric layer 72 of the top covering stratum 70 preferably lies adjacent to the dielectric layer 64 of the second transmission line supporting stratum 64.

In a preferred embodiment, the assembly further includes a plurality of apertures 76 (commonly called via holes), each defined by an aperture wall formed from a portion of the first transmission line supporting stratum 48, the intermediate stratum 56 and the second transmission line supporting stratum 62. Preferably, the via holes 76 are formed in the assembly after the first stratum 48, intermediate stratum 56, and second stratum 62 are layered upon the base plate 46. Thereafter, the top covering stratum 70 is attached to second stratum 62. The via holes can be formed by any known means for forming a hole through the dielectric and metallic layers such as by drilling to remove only the required material. The via holes 76 are formed through the assembly and are preferably adjacent to a corresponding transmission line as shown in FIG. 3. More specifically, the via holes are spaced apart from each other in parallel rows on each side of a transmission line. The spacing between via holes is selected in a well known manner to provide electrical isolation between the transmission lines.

Once the via holes 76 have been formed, each via hole wall is plated with a metallic material by any suitable method. The via holes 76 serve several purposes. Firstly, the via holes serve to couple each metallic layer of the various strata to the metal base plate 46 in order to have a common reference ground. Secondly, the via holes 76 serve to electrically isolate each transmission line 54,66 from adjacent respective transmission lines so as to minimize cross coupling and interference between the transmission lines. Finally, the control lines 24,26 (as previously described with regard to FIGS. 2 and 3) may be passed thru the via holes to their respective pin diode arrays 6 for selectively biasing the first, second and third diodes 18,20,22.

In an alternate embodiment of the present invention, the entire microwave crosspoint blocking switch matrix assembly further includes a ceramic or other non-conductive coating 78 (partially shown in FIG. 4) around the entire assembly for hermetic sealing of the device so that the assembly will be impervious to environmental effects such as dust, dirt and corrosive elements.

It should be noted that although the matrix is particularly suited for use with pin diodes, other devices, such as microwave switches, exhibiting an on (short circuit) and off (open circuit) state may be used in place of the pin diodes. As a result of the present invention, the transfer of a signal from an input transmission line to an output transmission line is accomplished without the insertion of a series switch component by severance of either transmission line at the respective crosspoint, which switch component is required in conventional switch matrices.

Although illustrative embodiments of the present invention have been described herein with reference to the accompanying drawings, it is to be understood that the invention is not limited to the precise embodiments, and that various other changes and modifications may be effected therein by one skilled in the art without departing from the scope or spirit of the invention.

What is claimed is:

1. A microwave crosspoint blocking switch matrix for routing an input signal having a signal wavelength (λ) comprising:

a plurality of input microwave transmission lines;

a plurality of output microwave transmission lines; and a plurality of switching arrays having first and second connection points and first and second nodes, each of the plurality of switching arrays being coupled to at least one of the plurality if input microwave transmission lines and to at least one of the plurality of output microwave transmission lines, each of the plurality of switching arrays selectively electrically coupling and decoupling a respective input microwave transmission line to a respective output microwave transmission line, each of the plurality of switching arrays having at least an interconnection device and first and second termination devices, the interconnection device being coupled between the first and second nodes, the first termination device being coupled between the first node and a ground potential, the second termination device being coupled between the second node and the ground potential, the interconnection device and first and second termination devices being selectively activated and deactivated.

2. A microwave crosspoint blocking switch matrix as defined by claim 1, each of the plurality of switching arrays further comprising:

at least first and second control lines each respectively coupled to one of the first and second nodes, the at least first and second control lines providing a voltage to the first and second nodes.

3. A microwave crosspoint blocking switch matrix as defined by claim 2 further comprising at least one decoupling filter means coupled to at least one of the control lines.

4. A microwave crosspoint blocking switch matrix as defined by claim 1, wherein the first connection point is respectively coupled to at least one of the plurality of input microwave transmission lines, and wherein the second connection point is respectively coupled and at least one of the plurality of output microwave transmission lines.

5. A microwave crosspoint blocking switch matrix as defined by claim 1, wherein each of the plurality of input microwave transmission lines is substantially parallel to adjacent input microwave transmission lines, and wherein each of the plurality of input microwave transmission lines is spaced from adjacent input microwave transmission lines by substantially $$\frac{\lambda}{4 \cdot 2^A},$$

where A is one of a positive integer and zero.

6. A microwave crosspoint blocking switch matrix as defined by claim 1, wherein each of the plurality of output microwave transmission lines is substantially parallel to adjacent output microwave transmission lines, and wherein each of the plurality of output microwave transmission lines is spaced from adjacent output microwave transmission lines by substantially $$\frac{\lambda}{4 \cdot 2^B},$$

where B is one of a positive integer and zero.

7. A microwave crosspoint blocking switch matrix as defined by claim 1 each of the plurality of switching arrays further comprising:

at least first and second control lines respectively coupled to one of the first and second nodes, the at least first and second control lines providing a voltage to the first and second nodes, the interconnection device and first and second termination devices activating and deactivating in response to the voltage provided by the first and second control lines to the first and second nodes.

8. A microwave crosspoint blocking switch matrix as defined by claim 1, each of the plurality of switching arrays further comprising:

at least first, second and third diodes, the cathode of the first diode being coupled to the first node, the anode of the second diode being coupled to first node, the anode of the first diode being coupled to the second node, the cathode of the third diode being coupled to the second node, and the cathode of the second diode and the anode of the third diode being coupled to a ground potential.

9. A microwave crosspoint blocking switch matrix as defined by claim 8 further comprising:

at least first and second control lines respectively coupled to one of the first and second nodes, the at least first and second control lines providing a voltage to the first and second nodes, the first, second and third diodes activating and deactivating in response to the voltage provided by the first and second control lines to the first and second nodes.

10. A microwave crosspoint blocking switch matrix as defined by claim 1, each of the plurality of switching arrays further comprising:

at least first, second and third diodes, the anode of the first diode being coupled to the first node, the cathode of the second diode being coupled to the first node, the cathode of the first diode being coupled to the second node, the anode of the third diode being coupled to the second node, and the anode of the second diode and the cathode of the third diode being coupled to a ground potential.

11. A microwave crosspoint blocking switch matrix as defined by claim 10 further comprising:

at least first and second control lines respectively coupled to one of the first and second nodes, the at least first and second control lines providing a voltage to the first and second nodes, the first, second and third diodes activating and deactivating in response to the voltage provided by the first and second control lines to the first and second nodes.

12. A microwave crosspoint blocking switch matrix as defined by claim 1, each of the plurality of switching arrays further comprising:

at least one filter means coupled between one of the first node and the first connection point and the second node and the second connection point, the at least one filter means providing a DC voltage block between one of the first and second connection points and one of the first and second nodes.

13. A microwave crosspoint blocking switch matrix as defined by claim 12, wherein the at least one filter means includes at least one capacitor.

14. A microwave crosspoint blocking switch matrix assembly for routing an input signal having a signal wavelength (λ) comprising:

a substrate supporting base plate;

a first transmission line supporting stratum including a metallic layer and a dielectric layer attached thereto, the dielectric layer having a plurality of parallel arranged first transmission lines affixed thereto, adjacent transmission lines of the plurality of first transmission lines being spaced by substantially $$\frac{\lambda}{4 \cdot 2^A},$$

where A is one of a positive integer and zero, the metallic layer of the first transmission line supporting stratum being attached to the substrate supporting base plate;

an intermediate stratum including a dielectric layer and a metallic layer situated adjacent thereto, the dielectric layer of the intermediate stratum being affixed to the dielectric layer of the first transmission line supporting stratum;

a second transmission line supporting stratum attached to the intermediate stratum, the second transmission line supporting stratum including a dielectric layer having a plurality of parallel arranged second transmission lines affixed thereto, adjacent transmission lines of the plurality of second transmission lines being spaced by substantially $$\frac{\lambda}{4 \cdot 2^B},$$

where B is one of a positive integer and zero, the plurality of second transmission lines being arranged transversely to the plurality of first transmission lines to define a plurality of crosspoints of the first and second transmission lines;

a plurality of pin diode arrays mounted on at least one of the first transmission line supporting stratum, the intermediate stratum and the second transmission line supporting stratum, each of the plurality of pin diode arrays being coupled to at least one of the plurality of first transmission lines and at least one of the plurality of second transmission lines proximate to a respective crosspoint; and a top covering stratum including a dielectric layer and a metallic layer, the dielectric layer of the top covering stratum being situated adjacent and coupled to the dielectric layer of the second transmission line supporting stratum.

15. A microwave crosspoint blocking switch matrix assembly as defined by claim 14, further comprising:

a plurality of apertures, each of the plurality of apertures having an aperture wall defined by a portion of the first transmission line supporting stratum, the intermediate stratum, the second transmission line supporting stratum and the top covering stratum, each of the plurality of apertures being substantially adjacent to at least one of the first and second transmission lines, each of the aperture walls being plated with a conductive material.

16. A microwave crosspoint blocking switch matrix assembly as defined by claim 15, wherein each of the plurality of apertures extend substantially through the microwave crosspoint blocking switch matrix assembly from the metallic layer of the top covering stratum to the metallic layer of the first transmission line supporting stratum.

17. A microwave crosspoint blocking switch matrix assembly as defined by claim 15, the switching array further including first and second connection points and first and second nodes, each of the first and second connection points being respectively coupled to one of a first transmission line and a second transmission line.

18. A microwave crosspoint blocking switch matrix assembly as defined by claim 17, the switching array further comprising:

at least first, second and third diodes, the cathode of the first diode being coupled to the first node, the anode of the second diode being coupled to first node, the anode of the first diode being coupled to the second node, the cathode of the third diode being coupled to the second node, and the cathode of the second diode and the anode of the third diode being coupled to a ground potential.

19. A microwave crosspoint blocking switch matrix assembly as defined by claim 17, the switching array further comprising:

at least first, second and third diodes, the anode of the first diode being coupled to the first node, the cathode of the second diode being coupled to first node, the cathode of the first diode being coupled to the second node, the anode of the third diode being coupled to the second node, and the anode of the second diode and the cathode of the third diode being coupled to a ground potential.

20. A microwave crosspoint blocking switch matrix as defined by claim 17, the switching array further comprising:

at least an interconnection device and first and second termination devices, the interconnection device being coupled between the first and second nodes, the first termination device being coupled between the first node and a ground potential, the second termination device being coupled between the second node and the ground potential, the interconnection device and first and second termination devices being selectively activated and deactivated.

21. A microwave crosspoint blocking switch matrix assembly as defined by claim 20 further comprising:

at least first and second control lines respectively coupled to at least one of the first and second nodes, the at least first and second control lines providing a voltage to the first and second nodes, the interconnection device and first and second termination devices activating and deactivating in response to the voltage provided on the first and second control lines to the first and second nodes.

22. A microwave crosspoint blocking switch matrix assembly as defined by claim 21 further comprising:

at least one decoupling filter means coupled to at least one of the control lines.

23. A microwave crosspoint blocking switch matrix assembly as defined by claim 17 further comprising:

at least one filter means coupled between one of the first node and the first connection point and the second node and the second connection point, the at least one filter means providing a DC voltage block between one of the first and second connection points and one of the first and second nodes.

24. A microwave crosspoint blocking switch matrix assembly as defined by claim 23, wherein the at least one filter means includes at least one capacitor.

25. A method of selectively coupling one of a plurality of input microwave transmission lines to one of a plurality of output microwave transmission lines to route a signal having a wavelength ($\lambda$), the input microwave transmission lines and output microwave transmission lines being substantially non-parallel to each other and overlapping at at least one point to define a plurality of crosspoints, the method utilizing a plurality of pin diode arrays having at least first and second connection points, each of the at least first and second connection points of each of the plurality of pin diode arrays being attached to at least one of the plurality of input microwave transmission lines and to at least one of the plurality of output microwave transmission lines at each of the plurality crosspoints, each of the plurality of crosspoints being substantially spaced apart by $$\frac{\lambda}{4 \cdot 2^N}$$

where N is one of a positive integer and zero, each pin diode array including first and second nodes, each of the plurality of pin diode arrays having at least an interconnection device and first and second termination devices, the interconnection device being coupled between the first and second nodes, the first termination device being coupled between the first node and a ground potential, the second termination device being coupled between the second node and the ground potential, the method comprising:

selecting one of the plurality of input microwave transmission lines and one of the plurality of output microwave transmission lines for transmission of the signal, the selected input and output microwave transmission lines being coupled to a first pin diode array indicative of a first crosspoint;

activating the interconnecting diode of the first pin diode array at the first crosspoint;

activating the second termination device in a second pin diode array at a second crosspoint, the second crosspoint being indicative of the second pin diode array which selectively couples the selected input microwave transmission line to an unselected output microwave transmission line, the second crosspoint being located along the input microwave transmission line $$\frac{N\lambda}{4}$$

from the first crosspoint where N is a positive integer; and activating the first termination device in a third pin diode array at a third crosspoint, the third crosspoint being indicative of the third pin diode array which selectively couples the selected output microwave transmission line and an unselected input microwave transmission line, the third crosspoint being located along the output microwave transmission line $$\frac{N\lambda}{4}$$

from the first crosspoint, where N is a positive integer.

26. A method of selectively coupling one of a plurality of input transmission lines to one of a plurality of output transmission lines to route a signal having a wavelength (λ), each input transmission line being spaced substantially $$\frac{\lambda}{4 \cdot 2^A}$$

apart where A is one of a positive integer or zero, each output microwave transmission line being spaced substantially $$\frac{\lambda}{4 \cdot 2^B}$$

apart where B is one of a positive integer or zero, each input microwave transmission line and each output microwave transmission line being substantially nonparallel and overlapping at at least one point to define a plurality of crosspoints; the method including:

selecting one of the plurality of input transmission lines and one of the plurality of output transmission lines for transmission of the signal, the selected input and output microwave transmission lines determining a corresponding crosspoint;

providing a short circuit between the selected input transmission line and the selected output transmission line at the crosspoint defined thereby;

effecting a low impedance on the selected input transmission line at a distance on the input transmission line which is $$\frac{C\lambda}{4}$$

from the crosspoint where C is an odd integer, to reflect a high impedance on the input transmission line at the crosspoint;

effecting a low impedance on the selected output transmission line at a distance on the output transmission line which is $$\frac{D\lambda}{4}$$

from the crosspoint, where D is an odd integer, to reflect a high impedance on the output transmission line at the crosspoint.

* * * * *